US010529507B2

(12) United States Patent
Wang et al.

(10) Patent No.: US 10,529,507 B2
(45) Date of Patent: Jan. 7, 2020

(54) AUTOMATION CONTROL DEVICE

(71) Applicant: ABB Schweiz AG, Baden (CH)

(72) Inventors: Xiaobo Wang, Zhejiang (CN); Liang He, Zhejiang (CN); Zhe Liu, Zhejiang (CN); Axel Lohbeck, Zhejiang (CN)

(73) Assignee: ABB Schweiz AG, Baden (CH)

( * ) Notice: Subject to any disclaimer, the term of this patent is extended or adjusted under 35 U.S.C. 154(b) by 18 days.

(21) Appl. No.: 15/298,678

(22) Filed: Oct. 20, 2016

(65) Prior Publication Data

US 2017/0040128 A1 Feb. 9, 2017

Related U.S. Application Data

(63) Continuation of application No. PCT/CN2014/083602, filed on Aug. 1, 2014.

(51) Int. Cl.
*H01H 13/83* (2006.01)

(52) U.S. Cl.
CPC ..... *H01H 13/83* (2013.01); *H01H 2219/016* (2013.01); *H01H 2219/039* (2013.01); *H01H 2231/016* (2013.01)

(58) Field of Classification Search
CPC ..... G06F 3/0488; G06F 3/0414; G06F 3/044; G06F 3/0416; G06F 3/04847;
(Continued)

(56) References Cited

U.S. PATENT DOCUMENTS

2007/0152965 A1 7/2007 Krzyzanowski et al.
2008/0094373 A1* 4/2008 Song ..... G06F 1/1624 345/173

(Continued)

FOREIGN PATENT DOCUMENTS

CN 1494097 A 5/2004
CN 1885977 A 12/2006

(Continued)

OTHER PUBLICATIONS

State Intellectual Property Office of the P.R. China, International Search Report & Written Opinion issued in corresponding Application No. PCT/CN2014/083602, dated Apr. 28, 2015, 10 pp.

(Continued)

*Primary Examiner* — Ahmed M Saeed
(74) *Attorney, Agent, or Firm* — Taft Stettinius & Hollister LLP; J. Bruce Schelkopf

(57) ABSTRACT

The present application includes an automation control device with a control panel, the control panel comprising at least one button with specified control function; and at least one luminous element located adjacent to the at least one button; wherein the at least one button is operable in a locked mode and a standby mode; in the locked mode, the press on the button would not trigger the specified control function of the button but would light up the at least one luminous element and switch the button into the standby mode; and in the standby mode, the at least one luminous element keeps in lighting, and the press on the button would trigger the specified control function of the button. The automation device is adapted for safe and correct operation in dim or dark environment.

16 Claims, 5 Drawing Sheets

(58) Field of Classification Search
CPC .... G06F 3/0486; G06F 3/0202; G06F 1/1624; G06F 1/1662; G06F 1/169; G06F 19/00; G06F 19/3481; G06F 1/163; G06F 1/3271; G06F 3/0412; G06F 3/0485; G06F 3/04883; G06F 3/04895; G06F 9/45; H01H 13/83; H01H 2231/016; H01H 2219/016; H01H 2219/039
USPC ..... 200/310–314
See application file for complete search history.

(56) References Cited

U.S. PATENT DOCUMENTS

| | | | | |
|---|---|---|---|---|
| 2008/0224638 | A1* | 9/2008 | Cheng | H05B 33/0803 315/349 |
| 2009/0243509 | A1 | 10/2009 | Barnett et al. | |
| 2011/0002092 | A1 | 1/2011 | Bestle et al. | |
| 2012/0103776 | A1 | 5/2012 | Walker et al. | |
| 2013/0265741 | A1 | 10/2013 | Lee | |
| 2014/0076704 | A1* | 3/2014 | Los | H01H 13/807 200/513 |
| 2015/0082547 | A1* | 3/2015 | Boyd | G05D 7/0617 5/706 |

FOREIGN PATENT DOCUMENTS

| | | | |
|---|---|---|---|
| CN | 201397749 | Y | 2/2010 |
| CN | 101965752 | A | 2/2011 |
| CN | 102981766 | A | 3/2013 |
| EP | 1605433 | A1 | 12/2005 |
| KR | 1020110043012 | A | 4/2011 |
| TW | 200838131 | A | 9/2008 |

OTHER PUBLICATIONS

Extended European Search Report dated Mar. 13, 2018 in corresponding European application No. 14898373.7 (8 pages).
First Office Action, Chinese Patent Application No. 2014800781235, dated Nov. 16, 2017, 8 pages including English Translation.
Second Chinese Office Action, Chinese Patent Application No. 2014800781235, dated Sep. 5, 2018, 15 pages including English Translation.
Second Chinese Search Report, Chinese Patent Application No. 2014800781235, dated Sep. 5, 2018, 4 pages including English Translation.
Chinese Office Action, Chinese patent application No. 201480078123.5, dated May 7, 2019, 7 pages, also including herewith machine translation in English.

* cited by examiner

AUTOMATION CONTROL DEVICE

FIELD OF THE INVENTION

The present invention relates to the field of industrial control, especially an automation control device with a control panel for dim environment.

BACKGROUND OF THE INVENTION

Standalone automation control device is widely used as control device for small range process control in industry. Normally, it contains several input/output ports and configurable common process control algorithm (such as PID). After input/output ports are connected to field signals and process control algorithm is configured, a user can establish control loops and control process variables for a desired set point.

Almost all the standalone automation control devices use LED indicators on a control panel to show some information such as alarms, operation status, etc. However, most of the LED indicators simply comprise some lights with printed characters. The printed characters are difficult to read if the environment is dim or light is insufficient which is very likely to be the case because industrial automation control devices are frequently used under such environment. Moreover, the buttons on the panels are also difficult to be identified in a dim environment. Although some buttons on the control panels may be lighted up when they are in operation in the prior art, they are not lighted up until being pressed by user. As a result, it is also difficult for user to identify the buttons in a dim environment before the buttons are operated. These disadvantages cause inconvenient operation and increase possibilities of mis-operation, and then impact process control results.

SUMMARY OF THE INVENTION

Hence, one of the objectives of the present invention is to provide a solution to allow industrial automation control device to work under dim environment with convenient operations.

According to one aspect of the invention, an automation control device with a control panel is provided, the control panel comprising at least one button, each with specified control function; and at least one luminous element located under or adjacent to the at least one button. The at least one button is operable in locked mode and standby mode. In the locked mode, the press on any of the at least one button lights up the at least one luminous element and switches the at least one button to the standby mode without triggering the specified control function of the pressed button. In the standby mode, the at least one luminous element keeps in lighting, and the press on any of the at least one button triggers the specified control function of the pressed button. Since the first operation on the button would not trigger the control function of the button, the wrong operation on the button in the dim or dark environment is thus avoided. Since the button area is illuminated via the first press operation on the button, the user can identify the button clearly and operate the button correctly.

According to another aspect of the invention, if no further operation on any of the at least one button for a predetermined duration since the latest operation on the at least one button, the at least one button would be automatically switched from the standby mode back to the locked mode, and the at least one lighted luminous element would be turned off. Preferably, the predetermined duration is approximately 60 seconds. This further avoids the wrong operation or un-intended operation of the user due to incautiousness or absence from the control panel.

According to another aspect of the invention, the at least one button comprises multiple buttons, and the number of the at least one luminous element corresponds to the number of the multiple buttons, with each button associated with one luminous element respectively. The press on any of the multiple buttons in the locked mode would switch only the pressed button to the standby mode, and light up only the luminous element associated with the pressed button to illuminate the pressed button. In this way, a feedback of the pressed button can be provided to the user so that he/she can confirm his/her operation on a desired button each time, or he/she would realized he/she has just pressed a wrong button and then can adjust the next operation to a desired button. Furthermore, the respective activation of the buttons to standby mode further reduces the possibility of wrong operation of the buttons. As a result, the buttons can be operated more safely and correctly in the dim or dark environment.

According to another aspect of the invention, the control panel is divided into more than one regions, each of the regions comprising at least one luminous element and at least one button. The press on any of the at least one button in the locked mode in one region would switch only the at least one button in this region to the standby mode, and light up only the at least one luminous element in this region to illuminate this region. In this way, the user can easily light up the region where the desired button is located in a dim or dark environment. Meanwhile, since only the associated region is illuminated by the press on any button in this region while the luminous elements in other regions keep turned off, the energy can be saved compared to lighting up all the luminous elements on the panel. Furthermore, Since one region can be illuminated by several even only one luminous element(s) which number may be less than the number of the buttons in this region, the cost for the luminous elements can be reduced.

According to another aspect of the invention, the press on any button which is different from a previous pressed button would result in the luminous element corresponding to the previous pressed button being turned off, and the previous pressed button being switched to locked mode. As such, the user can pay attention on the one and only lighted button which is just pressed a moment ago, and the previous pressed button is prevented from being triggered to perform the control function by accident. Therefore, a safer operation can be achieved.

According to another aspect of the invention, the at least one button and the at least one luminous element are located on a circuit board, and wherein the control panel further comprises at least one light guide element covering the at least one button respectively, and a foil covering the at least one light guide element; wherein the regions on the foil corresponding to the at least one button are transparent or translucent and printed with characters or icons.

According to another aspect of the invention, the automation control device further comprises a processor for controlling mode switching of the at least one button and the operation of the at least one luminous element based on the press on the at least one button.

According to another aspect of the invention, an integrated circuit is connected to a first output of the processor, and at least one switch respectively corresponding to the at least one button are connected between the integrated circuit and an input of the processor in parallel; and a semiconductor switching element is also provided and connected to the at least one luminous element, which control electrode is connected to a second output of the processor, and the at least one luminous element is connected in parallel.

According to another aspect of the invention, the integrated circuit is configured to send high level signal to one of the at least one switch alternately in response to the instructions from the processor.

According to another aspect of the invention, a chip is connected between the processor and the at least one luminous element for controlling a part of the at least one luminous element to light up in response to the instructions from the processor.

According to another aspect of the invention, the luminous element is a LED light.

According to another aspect of the invention, the control panel further comprises a display and indicators, which indicators can be illuminated by additional luminous elements.

BRIEF DESCRIPTION OF THE DRAWINGS

When reading the following detailed description on the exemplary embodiments with reference to the drawings, the aim, features and advantages of the present invention become obvious, wherein.

DETAILED DESCRIPTION OF EMBODIMENTS

Figure 1:
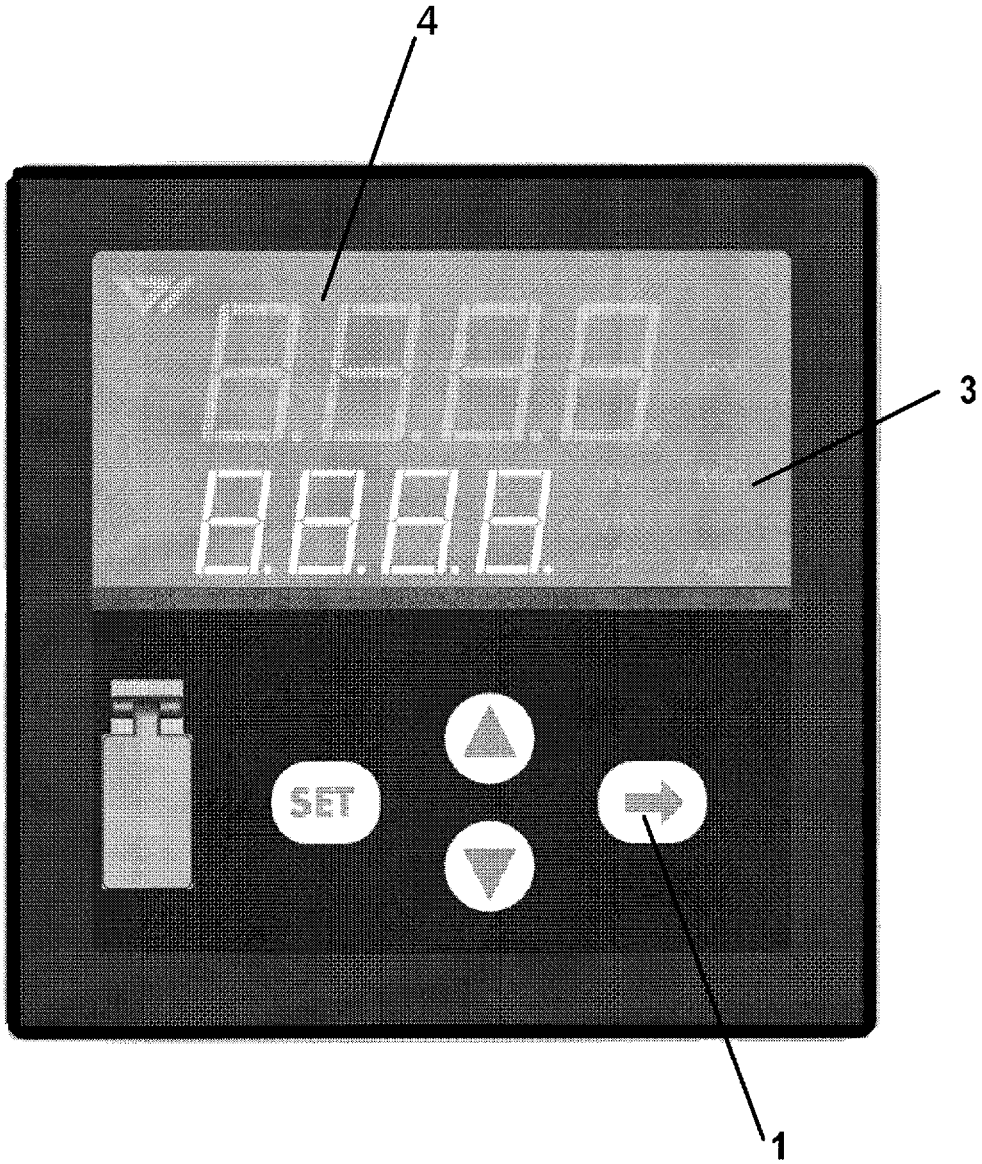
FIG. 1 illustrates the appearance of an automation control device with a control panel according to embodiments of the present invention.

Hereinafter, a few exemplary embodiments will be referred to in describing the mechanism and spirit of the present invention. It should be understood that these embodiments are merely provided to facilitate those skilled in the art in understanding and in turn implementing the present invention, but not for limiting the scope of the present invention in any way.

Various embodiments of the present invention are described in detail herein in an exemplary way by referring to the drawings.

FIG. 1 illustrates the appearance of a control panel for an automation control device according to embodiments of the present invention. The control panel can be used in any kind of control system, such as industrial process control system and machining device control system. The control panel comprises at least one button 1 with specified control function. Four buttons 1 are shown in FIG. 1 having the functions of navigating upwards and downwards, setting and entering respectively. It is appreciated for the skilled person that any number of buttons 1 can be provided on the control panel, and the specified control function of the at least one button 1 can be various kinds of functions according to the specific application, including navigating operation, action triggering, performing instructions etc.

Figure 2:
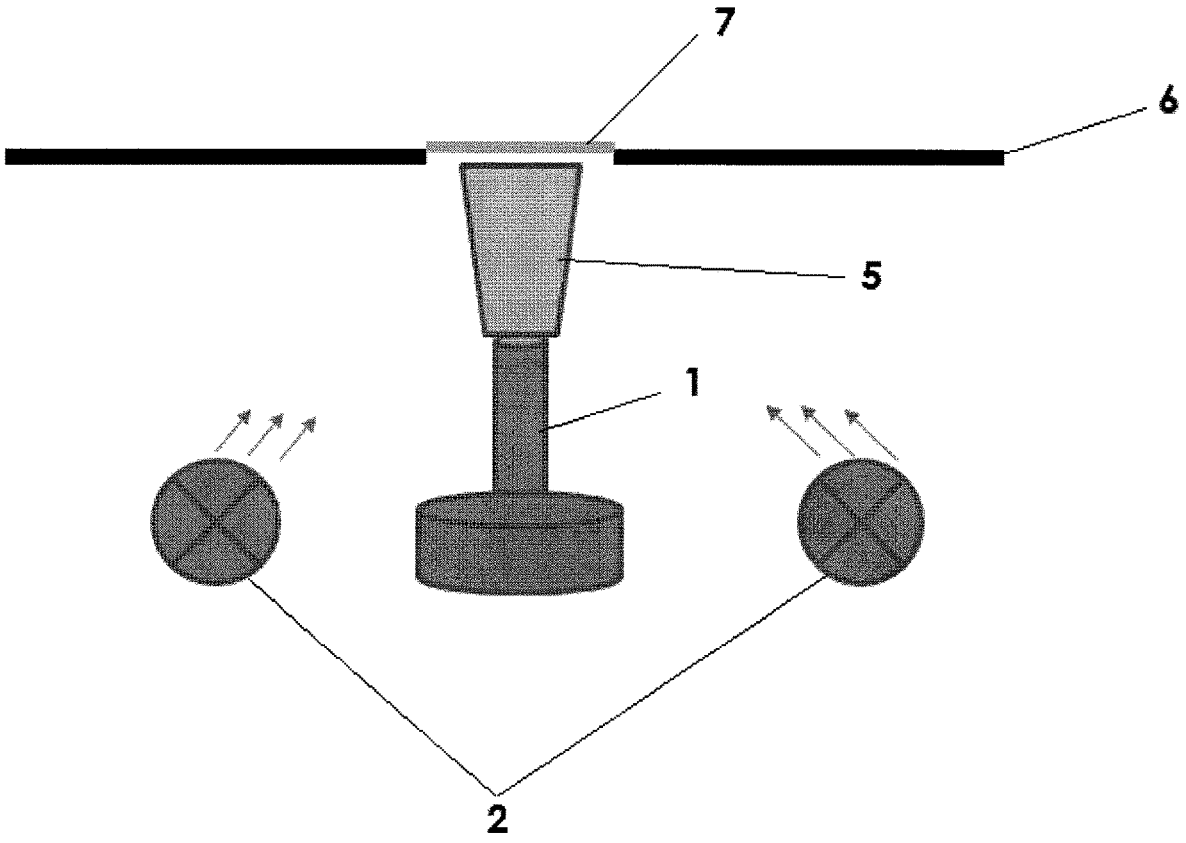
FIG. 2 schematically illustrates the arrangement of the buttons and luminous elements on the control panel.
Figure 4:
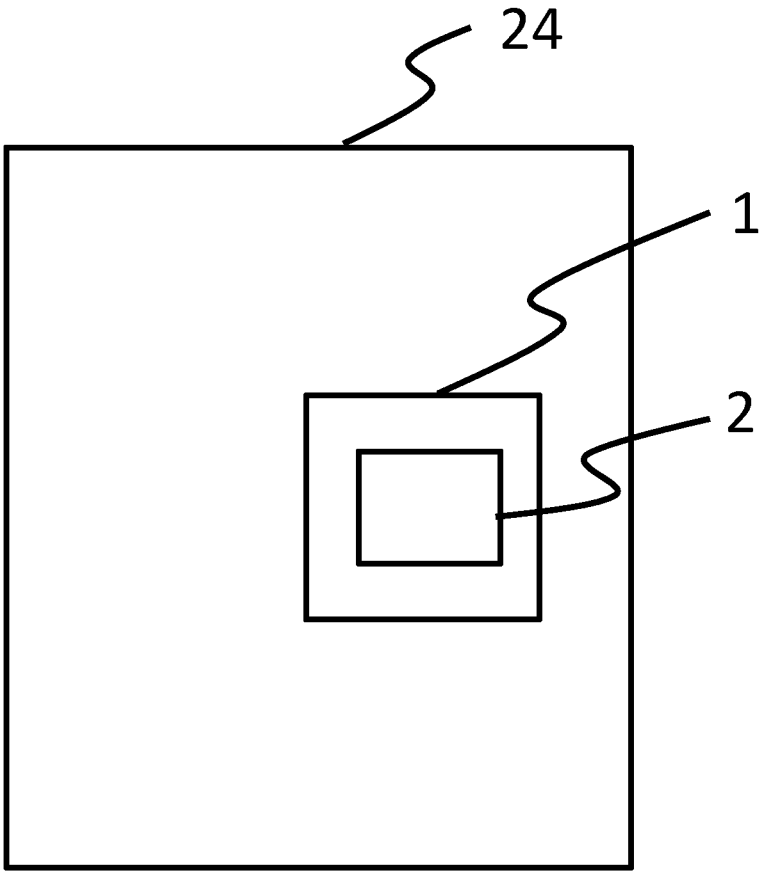
FIG. 4 illustrates an embodiment of a button and luminous element located on a circuit board.

The at least one button 1 is located on a circuit board 24 (shown in FIG. 4) of the control panel so as to be connected to a switch circuit of the control system. At least one luminous element 2 (not shown in FIG. 1 but shown in FIGS. 2 and 4), preferably at least one light emitting diode (LED), is also located on the circuit board (see FIG. 4) under or adjacent to the at least one button 1. FIG. 2 schematically illustrates the arrangement of the buttons and luminous elements on the control panel, wherein two LEDs 2 and a button 1 are located under a panel 6. The panel 6 has an opening in the position corresponding to the button 1. A flexible foil Ton the panel 6 at least covers the opening in the panel. The area of the foil 7 corresponding to the opening is transparent or translucent and printed with characters or icons. A light guide element 5 is attached to the lower surface of the foil 7, while keeping the light guide element 5 just above the button 1. The two LEDs are located on different sides of one button 1. By this arrangement, the light emitted from the two LEDs 2 can pass through the light guide element 5 and opening in the panel 6 to illuminate the characters or icons on the foil 7, such that the user can identify the corresponding button 1 clearly. The light guide element 5 is stiff enough such that the press on the area of the foil 7 corresponding to the button 1 can be transmitted to the button 1 via the light guide element 5 to trigger the button 1. This arrangement can be applied for every button 1 on the control panel.

The control panel may also comprise a display 4 and indicators 3 for indicating related parameters and status of the control system for the user, as shown in FIG. 1. The indicators 3 can be illuminated by additional luminous elements, in particular LED lights. Preferably, one luminous element is provided for each indicator under or adjacent to the corresponding indicator. In this way, each indicator can be illuminated clearly with dedicated luminous element, which provides better readability for the user compared to those indicators illuminated by the light scattered on the control panel with non-dedicated luminous elements. The indicators 3 can be arranged in the similar way as for the button 1. Specifically, the luminous element dedicated for the indicator 3 can be located right below the light guide element 5, and the transparent or translucent area of the foil 7 corresponding to the opening in the panel 6 is printed with characters or icons indicating the related parameters and status of the control system. In this way, the light from the dedicated luminous element can directly illuminate the corresponding characters or icons on the foil 7 via the light guide element 5 and the opening. Alternatively, the light guide element 5 can be omitted.

The at least one button 1 is also electrically connected to the at least one luminous element 2, and the at least one button 1 can be operated associated with the at least one luminous element 2. Specifically, the at least one button 1 is operable in locked mode and standby mode. In the locked mode, the press on the button 1 would not trigger the specified control function of the button 1 but would light up the at least one luminous element 2 and switch the button 1 to the standby mode; and in the standby mode, the at least one luminous element 2 keeps in lighting, and the press on the button 1 would trigger the specified control function of the button 1. In another word, the first press on any of the at least one button 1 by user would only activate the illumination of the button 1, such that the user can see and know the exact position of the button 1 on the control panel and the control function thereof indicated by the characters or icons in a dim or even totally dark environment, and then the user can operate the desired button 1 correctly. Since the at least one button 1 has been switched to the standby mode by the first press operation, the second correct press on the desired button 1 would trigger the control function of the button, such that the desired control is realized. Since the first press operation on any button 1 in the locked mode (corresponding to the occasion that the at least one luminous element 2 has not been lighted up) would not trigger any control function of the buttons 1, the arbitrary press operation on the button area of the control panel due to the dim or dark environment would not result in a wrong control operation for the control system. As such, a convenient operation for the user is achieved and the safety for the operation to the control system is also improved, particularly in a dim or dark environment.

Preferably, if no further operation on the at least one button 1 for a predetermined duration (preferably approximately 60 seconds) since the latest operation on the at least one button 1, the at least one button 1 would be automatically switched from the standby mode back to the locked mode, and the lighted at least one luminous element 2 would be turned off. This avoids the at least one button 1 staying in standby mode for a long time without any further operation. The at least one button in standby mode for a long time without any further operation normally means the user has diverted his/her attention away from the buttons of the control panel or even walked away from the control panel, in which case the user may forget the status of the buttons or may touch any buttons accidently, and another user coming to the control panel afterwards may not know the standby status of the buttons. In these cases, the buttons are probably to be mis-operated. By automatically switching the buttons 1 to locked mode after a predetermined duration since the latest operation on the at least one button 1, the buttons 1 will be turned back to safe locked status, which avoids the possible misoperation by the user. Once the user wants to operate the buttons again, he/she has to firstly press any button 1 to switch the button to the standby mode again and confirm the standby status of the buttons, and then press the desired button 1 to trigger the corresponding control function. Those first accident operations on any button 1 would not trigger the control function immediately, but would light up the luminous elements 2 to inform or warn the user that he/she has touched any button 1 on the control panel and the buttons 1 are now in standby mode, such that the user's attention would be dragged back to the control panel so the user would notice the standby status of the buttons 1, and he/she would pay more attention when touching the buttons 1 and would press the buttons carefully.

According to a preferable embodiment, the at least one button 1 comprises multiple buttons 1, and the press on any of the multiple buttons 1 in the locked mode would switch all of the multiple buttons 1 to the standby mode. The press on any of the multiple buttons 1 in the locked mode would also light up all of the at least one luminous element 2. The at least one luminous element 2 would illuminate all the buttons 1 such that the user can see all the buttons clearly in a dim or dark environment. Then the user can locate the desired button 1 and press it to trigger the corresponding control function. In this way, the user does not need to locate the desired button in the first press operation with difficulty in the dim or dark environment, and any press operation in the button area can also light up all the buttons which facilitate the convenience of operating the buttons in the dim or dark environment.

According to another preferable embodiment, the at least one button 1 comprises multiple buttons 1, and the number of the at least one luminous element 2 corresponds to the number of the multiple buttons 1, with each button 1 associated with one luminous element 2 respectively. Each luminous element 2 is located under or adjacent to the corresponding button 1 and is used to illuminate only the corresponding button 1. This can be done by separating the at least one luminous element 2 into several regions isolated from each other by means of optical isolating elements. The buttons 1 are configured that the press on any of the multiple buttons 1 in the locked mode would switch only the pressed button 1 to the standby mode, and light up only the luminous element 2 associated with the pressed buttons 1 to illuminate and indicate the current status of the pressed buttons, while the other buttons are still in locked mode, and the other luminous elements 2 are still in the off status. In this way, each button 1 is lighted up and switched to standby mode separately by each press operation on the button such that the lighted button can give a feedback to the user. As a result, the user can realize which button has just been pressed such that he/she can confirm his/her operation on a desired button each time, or he/she would realized he/she has just press a wrong button and then can adjust the next operation to a desired button. In another hand, since only the pressed one button is switched to standby mode for each operation, the next accident operation on other buttons would not wrongly trigger the control functions of the other buttons since they are still in locked mode. Therefore, the buttons can be operated more safely and correctly in the dim or dark environment. Preferably, the press on the button which is different from the previous pressed button would result in the luminous element 2 corresponding to the previous pressed button being turned off, and the previous pressed button being switched to locked mode. As such, the user can focus on the only lighted button which is just pressed a moment ago, and the previously pressed button is prevented from being triggered to perform the control function by accident.

For this embodiment, it is advantageous to reduce the aforementioned predetermined duration, for example, to several seconds, preferably to less than 10 seconds. By reducing the predetermined duration to a proper value, there will still be adequate time for the user to identify and confirm the pressed button and press the same button again within the predetermined duration if it is recognized as the desired button so as to trigger the control function of the button, while the predetermined duration would not last too long to increase the risk of mis-operation in the case that the first pressed button is recognized as not the desired button and is not desired to be pressed again and triggered.

Similarly, the at least one luminous element 2 can be used to illuminate a part of the whole control panel or several buttons close to each other. For example, the control panel can be divided into several regions which are optically isolated from each other. There is at least one luminous element 2 and at least one button 1 (preferably several buttons) in one of the regions. Once any button in one region is pressed, all the luminous elements 2 in this region would be lighted up to illuminate the whole region and the buttons in this region. Preferably, only the buttons in this region are then switched to standby mode, such that the user can identify and press the desired button in this region in a dim or dark environment, and the pressed button can be triggered to perform the specified function. In this way, the user can easily light up the region where the desired button is located in a dim or dark environment. As a result it is more convenient for the user to operate the buttons in a dim or dark environment. Meanwhile, since only the associated region is illuminated by the press on any button in this region while the luminous elements 2 in other regions keep turned off, the energy can be saved compared to lighting up all the luminous elements 2 on the panel. Furthermore, as one region can be illuminated by several even only one luminous element(s) 2 which number may be less than the number of the buttons in this region, the cost for the luminous elements can be reduced.

Figure 3:
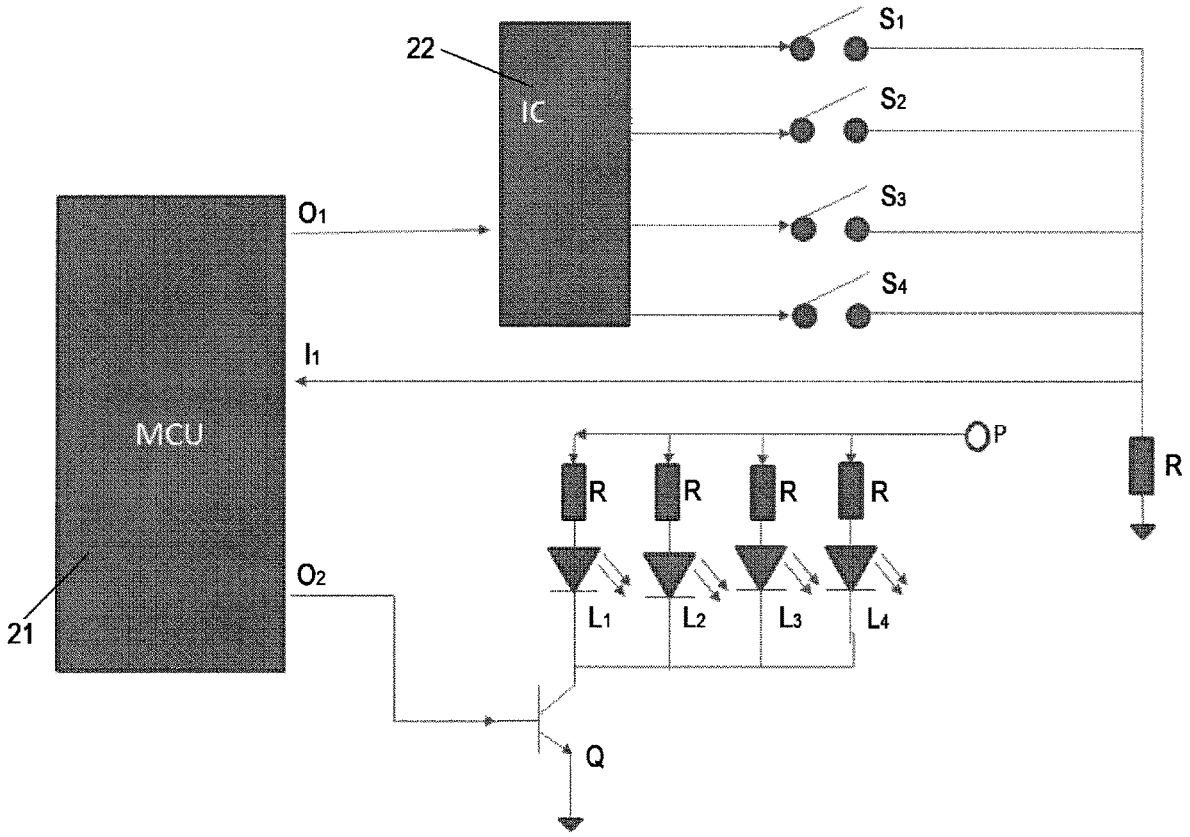
FIG. 3 illustrates the circuit diagram of the buttons and the associated luminous elements of the control panel according to embodiments of the present invention.

The control logic of the buttons 1 and associated luminous elements 2 according to the above embodiments can be implemented by programs in combination with some hardware. FIG. 3 shows an exemplary circuit diagram for the buttons and associated luminous elements according to the embodiments of the present invention. In FIG. 3, four switches S1-S4 corresponding to the four buttons 1 are provided, and four LED lights L1-L4 are also provided as the luminous elements 2 associated with the four switches S1-S4 respectively. A processor 21 and an integrated circuit (IC) 22 are also provided to realize the control logic of the switches S1-S4 and the LEDs L1-L4. The processor can be any kind of means with logic calculating and memory functions, which can be programmed to perform the customized control logic. In FIG. 3, the processor is preferably a Micro-programmed Control Unit (MCU) 21. A first output terminal O1 of MCU is connected to the IC unit, and one end of the four switches S1-S4 are connected to the IC unit in parallel with each other, and the other end of the four switches S1-S4 are connected to an input terminal I1 of MCU. The four LED lights L1-L4 are connected in parallel to a power supply P and a semiconductor switching element Q, such as a MOSFET or a transistor. A second output terminal O2 of MCU is connected to the control electrode of the semiconductor switching element Q (for example, the gate electrode of the MOSFET). The circuit also comprises some necessary resistors R.

The four switches S1-S4 have been coded as, for example, "0001", "0010", "0100" and "1000". The codes for the four switches are also stored in the MCU 21 and the IC unit 22. The MCU sends instructions from O1 terminal to the IC unit 22 frequently to instruct the IC unit 22 to send high level signal to one of the four parallel switches S1-S4 alternately. If any of the four parallel switches S1-S4 is closed by the press operation on the corresponding button by the user, the high level signal from the IC unit 22 would be conducted through the closed switch to the MCU via the input terminal I1. Since the frequency of the alternate high level signal on the four parallel switches is so high such that any press operation on one of the four buttons would conduct the high level signal through the corresponding switch to the MCU. Upon first receiving the high level signal, the MCU may detect one button has been pressed. Then MCU would send out a high level signal from the output terminal O2 to the control electrode of the semiconductor switching element Q, such that the semiconductor switching element Q is switched on and the LED circuit would be conducted. As such, all of the four LED lights L1-L4 are lighted up to illuminate the corresponding buttons 1 on the control panel. The MCU also knows which switch has just been closed since the instruction of sending the high level signal to which switch each time is sent by MCU. When the first press operation on the button 1 is released, the closed switch would be opened, and the MCU would recognize that the first press operation has ended and the MCU may count the press operation as the first press by a counter which means the buttons 1 have been set to the standby mode.

When the user presses any of the four buttons 1 again, the MCU would recognize it as the second press operation since the previous press operation. According to the program stored in the MCU, the MCU would also identify which switch has been closed, and then send the control signal corresponding to the control function of the pressed switch/button to a controlled circuit via another output terminal (not shown), such that the control function of the button is realized.

The MCU may be provided with a timer for timing since the recorded latest press operation on any button. If the predetermined duration passes, the MCU will cancel the high level signal sent to the control electrode of the semiconductor switching element Q, such that all the LED lights will be turned off, and the counter in the MCU will be reset to zero which means the buttons 1 are set to the locked mode. If the user presses any button 1 in the locking mode, since the counter counts this operation as the first operation, the MCU would not send a control signal corresponding to the pressed button to the controlled circuit, but just send the high level signal to the semiconductor switching element Q to light up the LED lights L1-L4.

Figure 5:
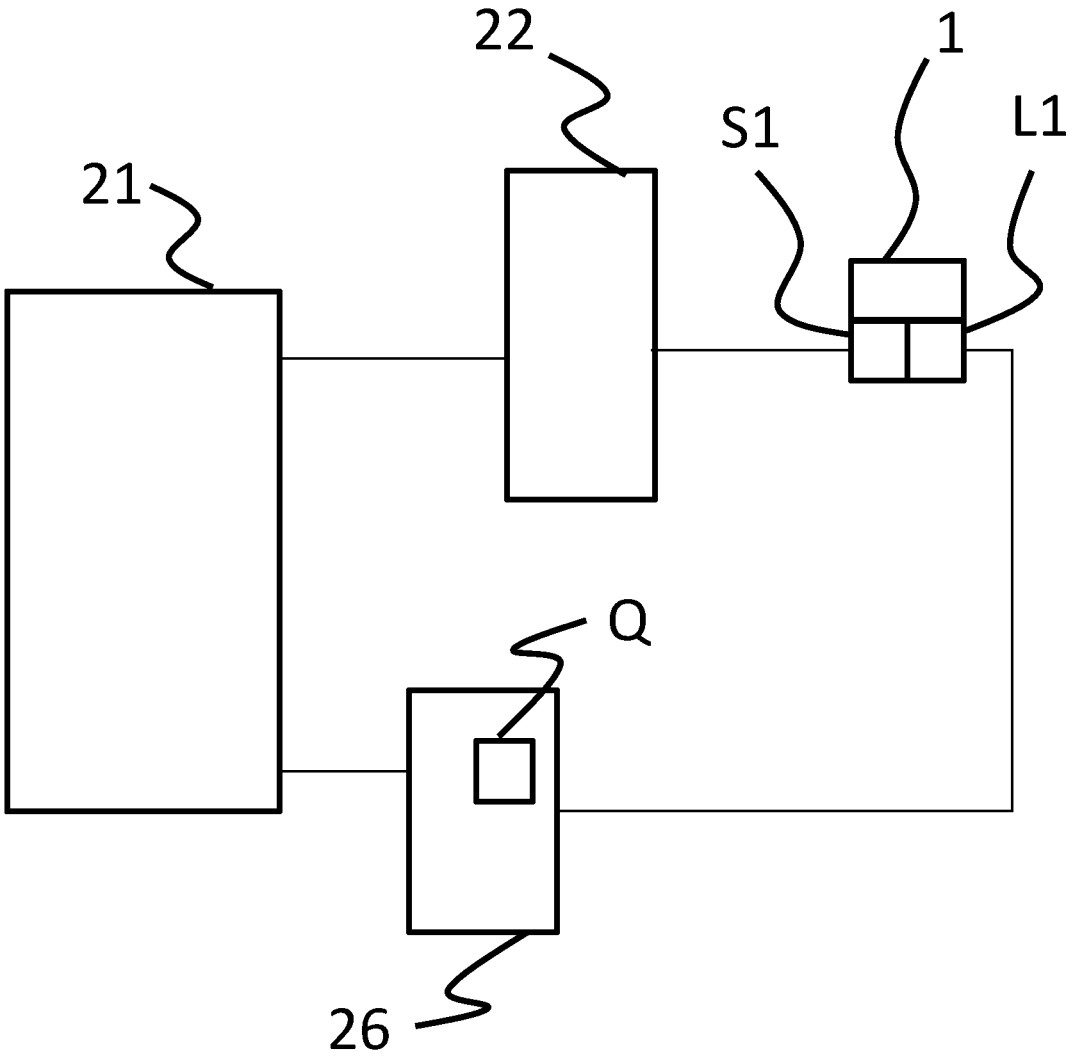
FIG. 5 illustrates a functional diagram of relationship a processor, switches, buttons, semiconductor switch, luminous elements, and chip.

According to another embodiment (e.g. seen in FIG. 5, albeit simplified to show only one button, etc for conciseness), another chip 26 is also provided between the processor 21 and the LED lights L1-L4 for controlling the selection of any of the four LED lights L1-L4 intended to be lighted up. The MCU identifies which switch has been firstly closed in the same way as in the above embodiment, and records the first closed switch, and then sends a signal to the chip connected to the LED lights to select only the LED light corresponding to the closed switch to be lighted up to illuminate the pressed button and provides a feedback to the user, while other LED lights keep turned off. Once a second press operation on any button 1 has taken, the MCU would also identify and record which switch has been closed and compare this record with the previous one. If the two records correspond to the press operations on the same button, the MCU would send the control signal corresponding to the control function of the pressed switch/button to a controlled circuit, such that the control function of the button is realized. If the two records correspond to the press operations on the different buttons, the MCU would not send any control signal corresponding to the control function of the buttons. Instead, the MCU would only light up the LED light corresponding to the newly pressed button. Preferably, the MCU would also turn off the previously lighted LED light corresponding to the other button previously pressed. Since the latest press record has been updated to the press on the new button, it is not possible for the previous pressed button to obtain two continuous press records in the MCU, thus the previous pressed button is switched to the locked mode due to the press operation on the new button. In this embodiment, it is also possible to provide a timer for timing since the previous press operation on any button. The time limit between the two operations on the button may also be used to control the control function of the buttons as in the previous embodiment.

Likewise, the chip between the processor 21 and the LED lights can also be used to control a part of the lights in one region to light up in response to the press on any button in this region, in case the lights and buttons have been divided into several regions as mentioned before. The processor 21 determines which region the pressed button belongs to according to its code, and instructs the chip to switch on the lights corresponding to this region such that only this region is illuminated.

By studying the drawings, the disclosure of the present text, and the attached Claims, those skilled in the art may understand and implement other modifications of the disclosed embodiments during the implementation of the present invention. In the claims, "comprising" does not exclude other elements or steps, and "a" or "one" does not exclude the plural concept. The simple fact of illustrating specific methods in the dependent claims, which are mutually different from each other, does not indicate that the combination of these methods cannot be used advantageously. The labels in drawings of the claims should not be interpreted as limiting the scopes thereof.

What is claimed is:

1. An automation control device with a control panel, the control panel comprising at least one button, each with a specified control function; and at least one luminous element located under or adjacent to the at least one button;

wherein the at least one button is operable in locked mode and standby mode;

in the locked mode, a first press on any of the at least one button lights up the at least one luminous element and switches the at least one button to the standby mode without triggering the specified control function of the pressed button;

and in the standby mode, the at least one luminous element keeps in lighting, and a second press on the at least one button pressed in the first press triggers the specified control function of the at least one button pressed in the first press and second press, wherein the specified control function associated with the second press is different from a lighting associated feature related to the first press;

wherein the at least one button comprises multiple buttons, and a number of the at least one luminous element corresponds to a number of the multiple buttons, with each button associated with one luminous element respectively, and wherein the first press on any of the multiple buttons in the locked mode would switch only the pressed button to the standby mode, and light up only the luminous element associated with the pressed button to illuminate the pressed button.

2. The automation control device according to claim 1, wherein if no further operation on any of the at least one button for a predetermined duration since the latest operation on the at least one button, the at least one button would be automatically switched from the standby mode back to the locked mode, and the lighted at least one luminous element would be turned off.

3. The automation control device according to claim 2, wherein the predetermined duration is approximately 60 seconds.

4. The automation control device according to claim 1, wherein the control panel is divided into more than one regions, each of the regions comprising at least one luminous element and at least one button, wherein the first press on any of the at least one button in the locked mode in one region would switch only the at least one button in this region to the standby mode, and light up only the at least one luminous element in this region to illuminate this region.

5. The automation control device according to claim 1, wherein the second press on any button which is different from a previous pressed button would result in the luminous element corresponding to the previous pressed button being turned off, and the previous pressed button being switched to locked mode.

6. The automation control device according to claim 1, wherein the at least one button and the at least one luminous element are located on a circuit board, and wherein the control panel further comprises at least one light guide element covering the at least one button respectively, and a foil covering the at least one light guide element;

wherein the regions on the foil corresponding to the at least one button are transparent or translucent and printed with characters or icons.

7. The automation control device according to claim 1, wherein the automation control device further comprises a processor for controlling mode switching of the at least one button and the operation of the at least one luminous element based on at least one of the first press and the second press on the at least one button.

8. The automation control device according to claim 7, wherein an integrated circuit is connected to a first output of the processor, and at least one switch respectively corresponding to the at least one button are connected between the integrated circuit and an input of the processor in parallel; and a semiconductor switching element is also provided and connected to the at least one luminous element, which control electrode is connected to a second output of the processor, and the at least one luminous element is connected in parallel.

9. The automation control device according to claim 8, wherein the integrated circuit is configured to send high level signal to one of the at least one switch alternately in response to the instructions from the processor.

10. The automation control device according to claim 8, wherein a chip is connected between the processor and the at least one luminous element for controlling a part of the at least one luminous element to light up in response to the instructions from the processor.

11. The automation control device according claim 1, wherein the luminous element is a LED light.

12. The automation control device according to claim 1, wherein the control panel further comprises a display and indicators, which indicators can be illuminated by additional luminous elements.

13. The automation control device according to claim 2, wherein the control panel is divided into more than one regions, each of the regions comprising at least one luminous element and at least one button, wherein the first press on any of the at least one button in the locked mode in one region would switch only the at least one button in this region to the standby mode, and light up only the at least one luminous element in this region to illuminate this region.

14. The automation control device according to claim 3, wherein the control panel is divided into more than one regions, each of the regions comprising at least one luminous element and at least one button, wherein the first press on any of the at least one button in the locked mode in one region would switch only the at least one button in this region to the standby mode, and light up only the at least one luminous element in this region to illuminate this region.

15. The automation control device according to claim 2, wherein the at least one button and the at least one luminous element are located on a circuit board, and wherein the control panel further comprises at least one light guide element covering the at least one button respectively, and a foil covering the at least one light guide element;

wherein the regions on the foil corresponding to the at least one button are transparent or translucent and printed with characters or icons.

16. The automation control device according to claim 3, wherein the at least one button and the at least one luminous element are located on a circuit board, and wherein the control panel further comprises at least one light guide element covering the at least one button respectively, and a foil covering the at least one light guide element;

wherein the regions on the foil corresponding to the at least one button are transparent or translucent and printed with characters or icons.

* * * * *